US007905301B2

(12) United States Patent
El Hakam et al.

(10) Patent No.: US 7,905,301 B2
(45) Date of Patent: Mar. 15, 2011

(54) EARTH BORING DRILL BITS MADE FROM A LOW-CARBON, HIGH-MOLYBDENUM ALLOY

(75) Inventors: Carmel Z. El Hakam, Houston, TX (US); Eric C. Sullivan, Houston, TX (US); John F. Bradford, III, Katy, TX (US); Don Q. Nguyen, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 147 days.

(21) Appl. No.: 12/166,954

(22) Filed: Jul. 2, 2008

(65) Prior Publication Data

US 2009/0008154 A1 Jan. 8, 2009

Related U.S. Application Data

(60) Provisional application No. 60/947,570, filed on Jul. 2, 2007.

(51) Int. Cl.
*E21B 10/46* (2006.01)

(52) U.S. Cl. ..... 175/425; 175/374

(58) Field of Classification Search ..... 175/374, 175/425

See application file for complete search history.

(56) References Cited

U.S. PATENT DOCUMENTS

| | | | | |
|---|---|---|---|---|
| 1,937,334 | A * | 11/1933 | Emmons | 420/67 |
| 2,347,375 | A * | 4/1944 | Stargardter | 148/319 |
| 3,661,658 | A * | 5/1972 | Oda et al. | 148/542 |
| 3,713,905 | A * | 1/1973 | Philip et al. | 148/319 |
| 3,868,487 | A * | 2/1975 | Ito et al. | 219/73 |
| 4,076,525 | A * | 2/1978 | Little et al. | 420/95 |
| 4,358,317 | A | 11/1982 | Abe | |
| 5,000,273 | A | 3/1991 | Horton et al. | |
| 5,213,634 | A * | 5/1993 | DeArdo et al. | 148/334 |
| 5,880,382 | A * | 3/1999 | Fang et al. | 75/236 |
| 6,655,478 | B2 * | 12/2003 | Liang et al. | 175/374 |
| 6,684,966 | B2 | 2/2004 | Lin et al. | |
| 7,044,243 | B2 | 5/2006 | Kembaiyan et al. | |
| 7,152,701 | B2 | 12/2006 | Butland et al. | |
| 7,210,377 | B2 | 5/2007 | Griffo et | |

FOREIGN PATENT DOCUMENTS

| | | |
|---|---|---|
| GB | 1542503 | 3/1979 |
| GB | 2212533 A | 7/1989 |
| GB | 2397832 A | 8/2004 |

(Continued)

OTHER PUBLICATIONS

International Search Report and Written Opinion dated May 28, 2009, 15 pages.

(Continued)

*Primary Examiner* — William P Neuder
*Assistant Examiner* — Blake Michener
(74) *Attorney, Agent, or Firm* — Bracewell & Giuliani LLP

(57) ABSTRACT

An earth boring bit formed from an alloy comprising a low carbon content and high molybdenum content is disclosed herein. The molybdenum content is greater than about 0.8% to about 1.15% by weight of the alloy. The carbon content may range up to about 0.16% by weight of the alloy. The alloy may further comprise alloy further comprises manganese, phosphorus, sulfur, silicon, nickel, chromium, copper, aluminum, vanadium, and calcium; with the balance being iron. The alloy experiences a relatively flattened hardenability curve and low martinsite formation.

10 Claims, 4 Drawing Sheets

FOREIGN PATENT DOCUMENTS

| | | | |
|---|---|---|---|
| JP | 54132418 | | 10/1979 |
| JP | 57192248 | | 11/1982 |
| JP | 59170221 | | 9/1984 |
| SU | 516757 | | 5/1976 |
| WO | 9748516 | A1 | 12/1997 |
| WO | 03062484 | A1 | 7/2003 |

OTHER PUBLICATIONS

Abstract for JP54132418, 1 page.
Abstract for JP57192248, 1 page.
Abstract for SU516757, 1 page.
Abstract for JP59170221, 1 page.

* cited by examiner

EARTH BORING DRILL BITS MADE FROM A LOW-CARBON, HIGH-MOLYBDENUM ALLOY

RELATED APPLICATIONS

This application claims priority to and the benefit of U.S. Provisional Application Ser. No. 60/947,570, filed Jul. 2, 2007, the full disclosure of which is hereby incorporated by reference herein.

BACKGROUND

1. Field of Invention

The disclosure herein relates to earth boring bits made from an alloy having high molybdenum content. More specifically this disclosure relates to earth boring bits comprised of an alloy having low carbon with high molybdenum. Yet, more specifically, the disclosure herein relates to earth boring bits having a low carbon content and a high molybdenum content, wherein the carbon content ranges up to 0.16% by weight and the molybdenum content exceeds 0.8% by weight.

2. Description of Prior Art

Drilling systems having earth boring drill bits are typically used in the oil and gas industry for creating wells drilled into hydrocarbon bearing substrata. Drilling systems typically comprise a drilling rig (not shown) used in conjunction with a rotating drill string wherein the drill bit is disposed on the terminal end of the drill string and used for boring through the subterranean formation. Drill bits typically are chosen from one of two types, either drag bits or roller cone bits. In FIG. 1, one example of a roller cone bit 10 is shown in perspective view. In this embodiment the roller cone bit 10 comprises a threaded connection 12 disposed on its upper most end for connection to the drill string. Formed on the lower most end of the threaded connection 12 is the bit body 14 which includes downwardly extending legs 18. Coaxially formed on each of the lower end of the legs 18 are roller cone cutters 20. A rolling cone bit 10 is designed such that the rolling cone cutters 20 rotate about their axis in conjunction with drill bit rotation. A series of cutting elements 22 are formed on the outer periphery of the rolling cone cutters 20. As is known, the cutting elements 22 contact the rock and subterranean formation and chip away individual pieces of the rock. An optional nozzle 16 may be included with the bit 10 for introducing a pressurized fluid, such as drilling fluid, during the cutting process. The drilling fluid (not shown) mixes with the cuttings and drill fluid pressure causes the cutting and fluid mixture to flow up the annulus formed between the drill string and the wellbore.

FIG. 2 illustrates a cross-sectional view of a portion of a drill bit 10*a*. In this embodiment, the cone cutter 20*a* is shown rotatingly mounted on a shaft 26. Bearings 28 are disposed on the outer circumference of a portion of the shaft 26 to aid in rotation of the cone cutter 20*a* about the shaft 26. As is known, weight on bit transferred to the rolling cone cutters 20*a* and cutting elements 22*a* via the threaded connection 12*a* produces localized stresses within sections of the body or leg section 18*a*. This is especially pronounced in sections such as the shoulder area 30, wherein the cross sectional area may be reduced in a portion of the bit 10*a*. These reduced areas therefore result in localized increases of stress which can lead to bit failure. Cyclic loading, either in the presence or absence of corrosive material, can lead to crack initiation and growth.

Roller cone earth boring bits are typically forged bodies comprised of a steel alloy, examples of known alloys include PS 30 and PS 55. Alloy PS 30 has a composition as follows: carbon 0.13%-0.18%, manganese 0.70%-0.90%, phosphorus 0.035% max, sulfur 0.040% max, silicon 0.15%-0.35%, nickel 0.70%-1.00%, chromium 0.45%-0.65%, molybdenum 0.45%-0.60%, and copper 0.35% max. For additional comparison purposes material properties of another alloy, referred to herein as PS 55, are provided in Table 1. The PS 55 composition includes carbon 0.15%-0.20%, manganese 0.70%-1.00%, phosphorus 0.025% max, sulfur 0.020% max, silicone 0.15%-0.35%, nickel 1.65%-2.00%, chromium 0.45%-0.65%, molybdenum 0.65%-0.80%, and copper 0.35% max.

SUMMARY OF INVENTION

In one embodiment, an alloy is disclosed having a low carbon content and a high molybdenum content, wherein the characteristics of the alloy produce an improved hardenability response relative to the current bit body steel. Additionally, the alloy also results in a low carbon martinsite formation. With reference to the alloy disclosed herein, low carbon corresponds to a carbon content of less than about 0.16% by weight; a high molybdenum content means molybdenum in quantities greater than about 0.8% by weight within the alloy. In one embodiment, the low carbon high molybdenum alloy is used for the formation of an earth boring drill bit. Optionally, the alloy may comprise a combination of the following elements, carbon at about 0.1% to about 0.15% by weight, manganese having about 0.7% to about 1% by weight, phosphorus having a content of up to about 0.035% by weight, sulfur with a content of up to about 0.02% by weight, silicon having a range percent by weight of about 0.15% to about 0.35%, nickel having a content range of about 1.65% to about 2% by weight, chromium ranging from about 0.45% to about 0.65% by weight, molybdenum ranging from about 0.8% to about 1.2% by weight, copper having a content of up to about 0.35% by weight, aluminum having percent by weight of about 0.2% to about 0.45%, vanadium having a content of up to about 0.01% by weight, and calcium having a content of up to about 0.003% by weight. Optionally, the steel may be formed without calcium treatment.

BRIEF DESCRIPTION OF DRAWINGS

Some of the features and benefits of the present invention having been stated, others will become apparent as the description proceeds when taken in conjunction with the accompanying drawings, in which.

Figure 1:
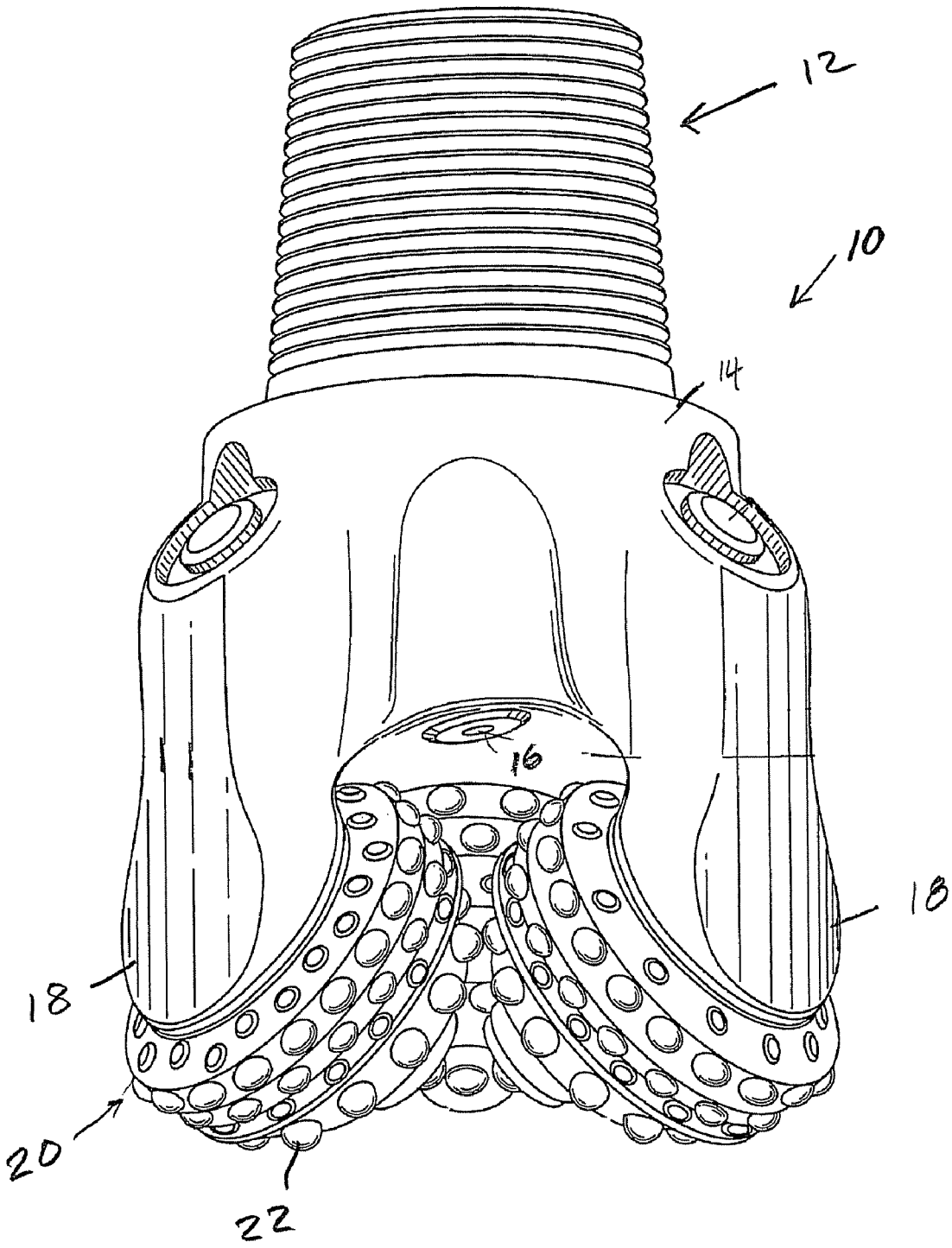
FIG. 1 illustrates an embodiment of a standard prior art earth boring bit.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be through and complete, and will fully convey the scope of the invention to those skilled in the art. Like numbers refer to like elements throughout.

It is to be understood that the invention is not limited to the exact details of construction, operation, exact materials, or embodiments shown and described, as modifications and equivalents will be apparent to one skilled in the art. For example, the scope of this disclosure includes alloys not being calcium treated, as well as earth boring bits made from such an alloy. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

Disclosed herein is an alloy having a low carbon content and a high molybdenum content. The alloy is useful for the manufacture of earth boring devices used in earth boring operations, wherein all or a portion of an earth boring device may include an earth boring drill bit. In one embodiment, the alloy comprises a carbon content of less than about 0.16% by weight with a corresponding molybdenum content of greater than about 0.8% by weight. In another embodiment, the carbon content ranges from about 0.01% to about 0.15% by weight, in yet another embodiment, the alloy may comprise carbon in an amount of about 0.05% to about 0.1% by weight. Embodiments of the alloy exist where the molybdenum content ranges from about 0.82% by weight to about 1.15% by weight, optionally the alloy can have molybdenum from about 0.85% by weight to about 1.12% by weight, or the alloy can have molybdenum from about 0.9% by weight to about 1.1% by weight.

Additional constituents of the alloy may comprise manganese in an amount of about 0.7% to about 1% by weight, phosphorus having a content up to about 0.035% by weight, sulfur having a content up to about 0.005% by weight, silicon ranging from about 0.15% to about 0.35% by weight, nickel ranging from about 1.65% to about 2% by weight, chromium ranging from about 0.45% to about 0.65% by weight, copper having a content of up to about 0.35% by weight, aluminum ranging from about 0.02% to about 0.45% by weight, vanadium ranging up to about 0.01% by weight, and calcium ranging up to about 0.003% by weight. The balance of the alloy may comprise iron. Embodiments of the alloy exist that include any value of weight percentage within the above listed ranges for the constituent materials. For example, chromium can be present in an amount of from about 0.45% by weight, about 0.65% by weight, or any value of weight percent between about 0.45% and about 0.65%. Additionally, the alloy also includes embodiments having combinations within these ranges.

EXAMPLE

In one non-limiting example, an alloy of the present disclosure and known alloys were tested for hardness and strength. The results of those tests are shown in Table 1 and FIG. 3. Advantages of the alloy described herein having the low carbon and high molybdenum content include increases in hardness in yield strength, along with a significant increase in the toughness over that of alloys with higher carbon and lower molybdenum content. The alloy that is the subject of the present disclosure is referred to herein as PS 55M. The PS 55M performance and properties were compared to the above described PS 30 and PS 55, both of which have a molybdenum content not greater than 0.8% by weight of the alloy. The particular embodiment of the PS 55M alloy tested had the following composition: manganese 0.70%-1.00%, phosphorus up to 0.025%, sulfur up to 0.005%, silicon 0.15%-0.35%, nickel 1.65%-2.00%, chromium 0.45%-0.65%, molybdenum 0.90%-1.10%, copper up to 0.35%, aluminum 0.020%-0.45%, vanadium up to 0.01%, and calcium ranging up to 0.003%. The values shown for the test models are in weight percent with the balance being iron.

TABLE 1

| | Hardness (HRC) | Yield Strength (PSI) | Ultimate Strength (PSI) | Yield/ Ultimate Ratio (%) | Longitudinal Impact Toughness (ft-lbf) |
|---|---|---|---|---|---|
| PS55 (Modified) | 35 | 128,000 | 160,000 | 80 | 103 |
| PS55 | 44.3 | 161,400 | 212,200 | 76 | 45 |
| AISI 4715 | 21 | 85,000 | 122,000 | 69 | 36 |

Figure 3:
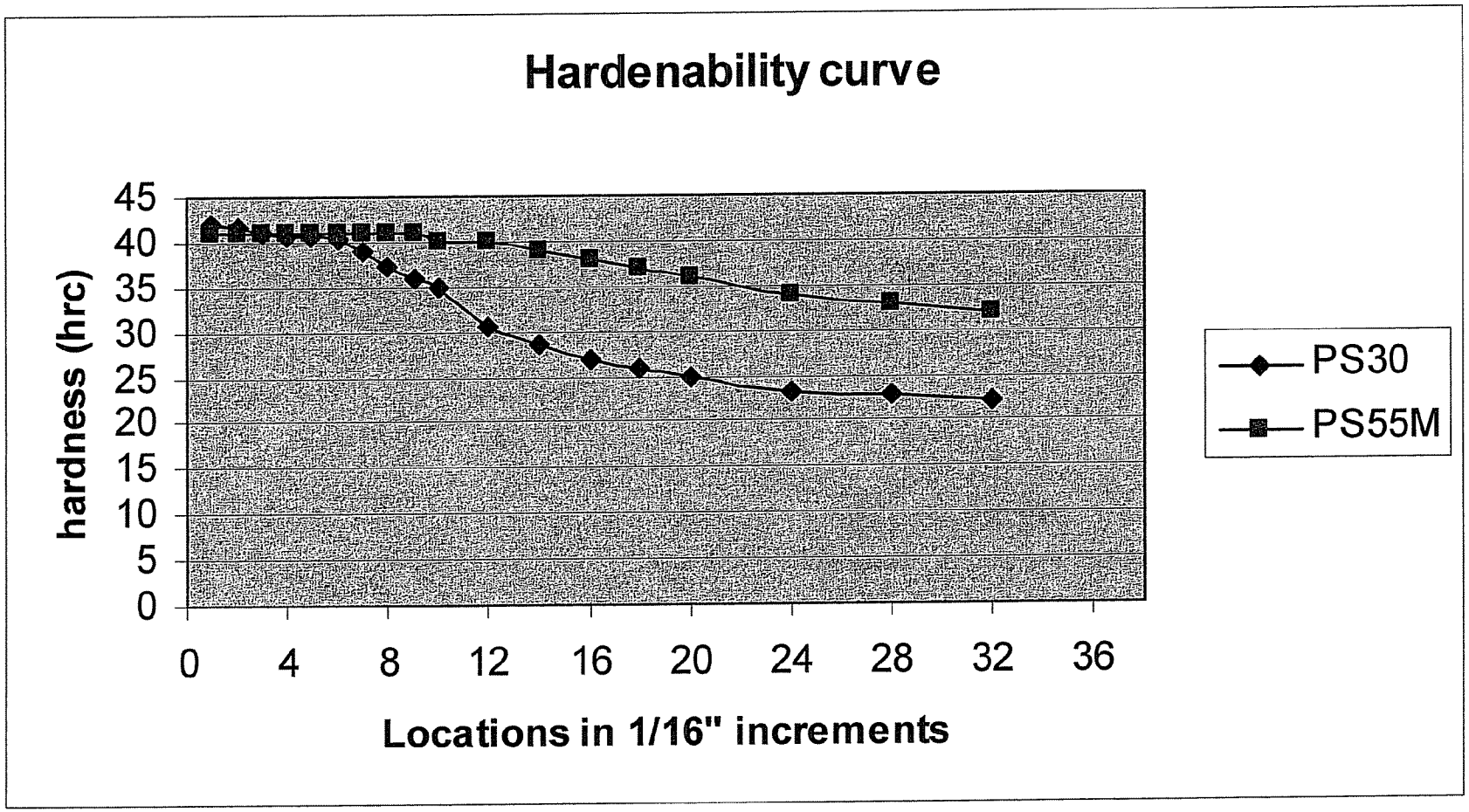
FIG. 3 is a graph illustrating a hardenability curve of a standard metal and an embodiment of an alloy disclosed herein.

From Table 1, it is clear that the combination of a low carbon and a high molybdenum content as described herein results in an alloy having enhanced materials properties of hardness and yield strength while yet maintaining a high toughness over that of standard alloys that lack the low carbon high molybdenum composition. FIG. 3 also illustrates the hardenability curve of the modified alloy versus a standard alloy (PS 30). FIG. 3 comprises a graph with data obtained from a Jominy test, wherein one test body was made using a standard material and the other was the modified alloy. FIG. 1 shows the test of hardness in 1/16" increments along the test bar wherein the increments start at the end of the test bar having been quenched. The quenching procedure followed ASTM A255. As can be seen from FIG. 3 the hardenability curve for the alloy disclosed herein maintains a relatively shaped curve in having a drop in hardness of less than 10 Rockwell units over the 2" evaluation region. In contrast, the alloy made from the standard constituents drops off almost 20 Rockwell hardness units at two inches from the tip. The flattened hardenability curve suggests an improved hardening response can be achieved.

Figure 2:
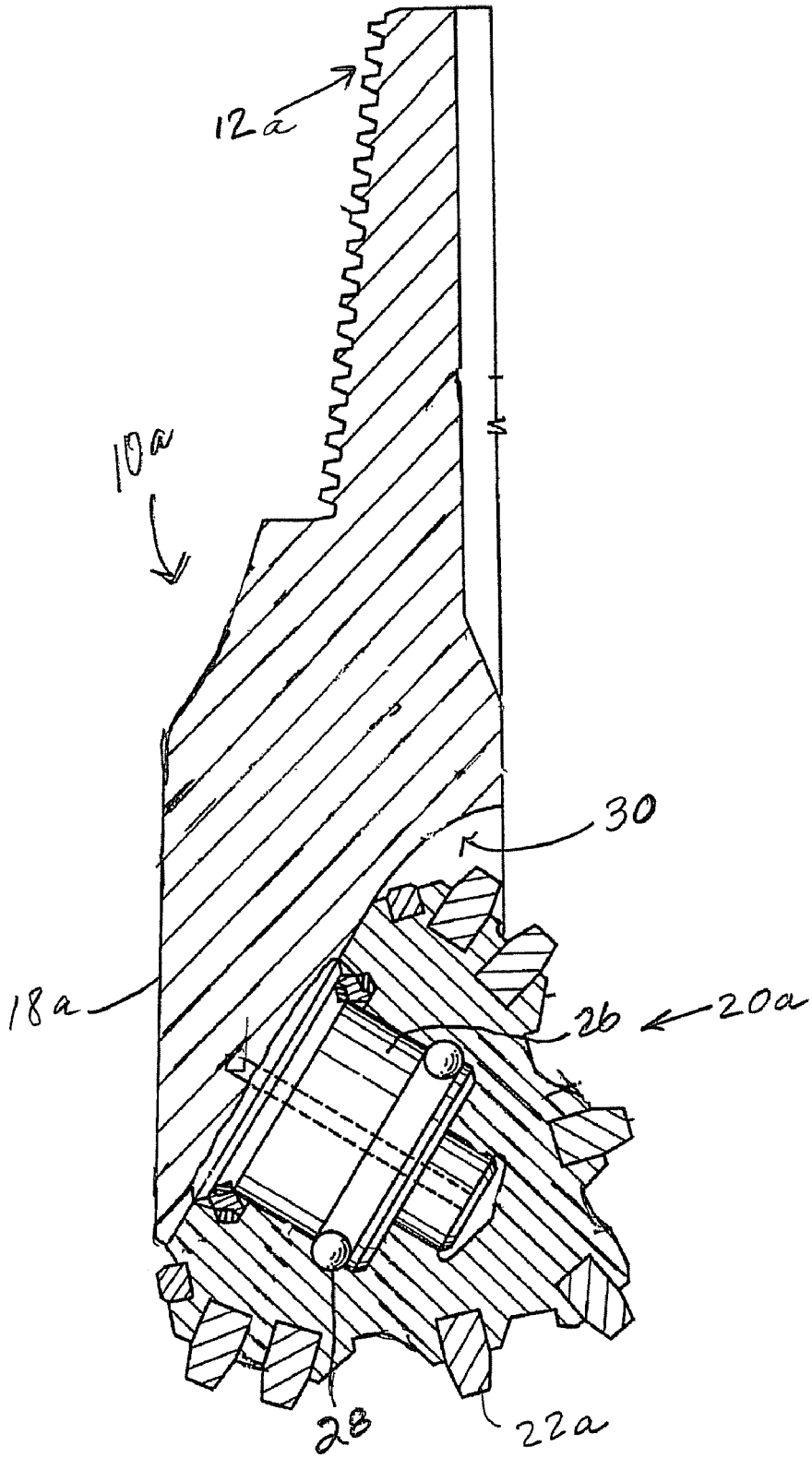
FIG. 2 illustrates a cross sectional view of a portion of an earth boring bit.

One of the advantages of the material characteristics of the modified alloy illustrated in Table 1 and in FIG. 3, especially with use in an earth boring drill bit, is an increase in bit strength in high stress areas, one example of a bit high stress are is the shoulder 30 illustrated in FIG. 2. Additionally, as is known, a high stress area experiencing repeated loading is more prone to crack initiation and growth, with or without exposure to corrosive agents. Fatigue failure will ultimately occur with sufficient crack growth. Accordingly, use of an alloy, especially when used in an earth drilling bit 10, can improve the load carrying capacity of the bit 10. Thus the alloy described herein, including alloy PS 55M, may be used in all bit sections, including the body section 14, the leg section 18, and optionally on the cones 20 as well.

Figure 4:
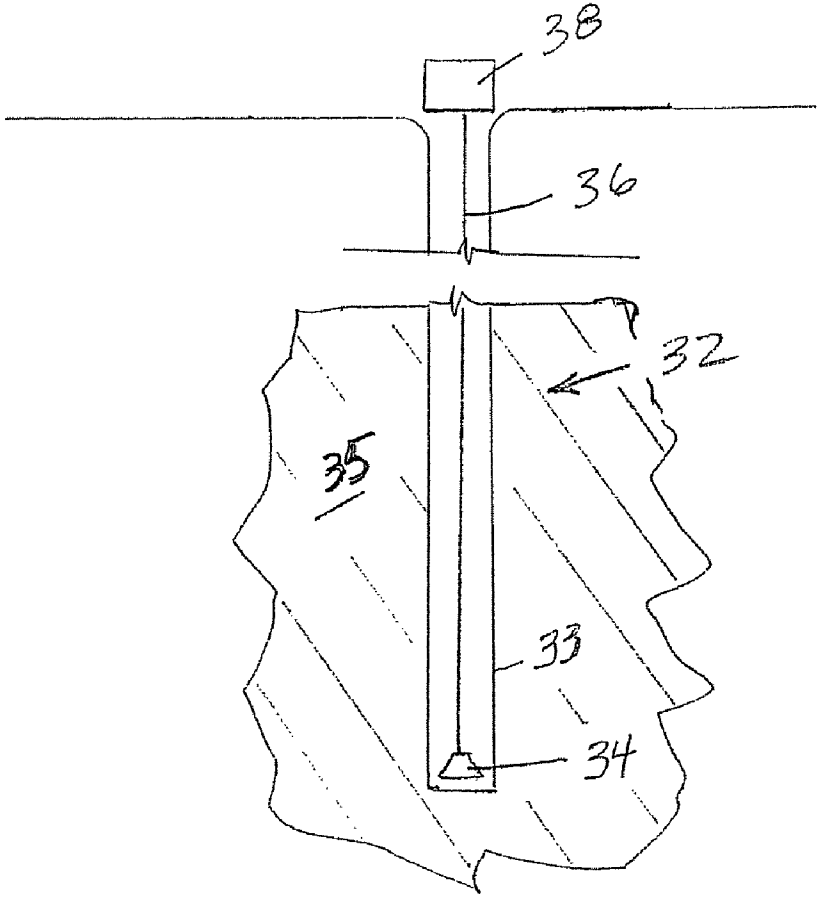
FIG. 4 depicts in a side section view a drilling system forming a borehole.

FIG. 4 illustrates an example of a drilling system 32 used in forming a wellbore 33 into a formation 35. The drilling system 32 comprises a drill bit 34 disposed on a lower end of a drill string 36. A top drive 38 connects to the drill string 36 upper end for rotating the drill string 36 and drill bit 34. Here all or a portion of the drill bit 34 may be formed using the high molybdenum alloy described herein. The drill bit 34 may be a roller cone bit or a drag or fixed bit.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims. While the invention has been shown in only one of its forms, it should be apparent to those skilled in the art that it is not so limited but is susceptible to various changes without departing from the scope of the invention.

We claim:

1. A device for use in earth boring operations comprising:

an earth boring bit having at least a portion thereof formed from a steel alloy comprising, molybdenum in a weight percent of the alloy from about 0.8% to about 1.2% and carbon in a weight percent of the alloy of from about 0.05% up to about 0.1%; and wherein the alloy further comprises nickel ranging from about 1.65% to about 2% by weight, and chromium ranging from about 0.45% to about 0.65% by weight.

2. The device of claim 1 wherein the alloy further comprises manganese, phosphorus, sulfur, silicon, copper, aluminum, vanadium, calcium, and iron.

3. The device of claim 1, wherein the alloy further comprises manganese in an amount of about 0.70% to about 1.00% by weight, phosphorus having a content up to about 0.035% by weight, sulfur having a content up to about 0.005% by weight, silicon ranging from about 0.15% to about 0.35% by weight, copper having a content of up to about 0.35% by weight, aluminum ranging from about 0.02% to about 0.45% by weight, vanadium ranging up to about 0.01% by weight, and calcium ranging up to about 0.003% by weight.

4. The device of claim 3, wherein the balance of the alloy comprises iron.

5. The device of claim 1, the earth boring bit comprising, a body having a bit leg; a cone rotatably mounted to the bit leg, a drill string connection, and teeth formed on the cone, wherein at least one of the body, the bit leg; the cone, the drill string connection, or teeth comprise the alloy.

6. The device of claim 5, wherein the bit body comprises the steel alloy.

7. An earth boring bit comprising:

a body having a bit leg;

a cone rotatably mounted to the bit leg;

teeth formed on the cone, wherein at least one of the body, the bit leg; the cone, or teeth include a steel alloy comprising, molybdenum in a weight percent of the alloy from about 0.8% to about 1.2% and carbon in a weight percent of the alloy of from about 0.05% up to 0.1%; and the alloy further comprises nickel ranging from about 1.65% to about 2% by weight, and chromium ranging from about 0.45% to about 0.65% by weight.

8. The earth boring bit of claim 7, wherein the alloy further comprises manganese, phosphorus, sulfur, silicon, copper, aluminum, vanadium, calcium, and iron.

9. The earth boring bit of claim 7, wherein the alloy further comprises manganese in an amount of about 0.70% to about 1.00% by weight, phosphorus in an amount up to about 0.035% by weight, sulfur in an amount up to about 0.005% by weight, silicon in an amount ranging from about 0.15% to about 0.35% by weight, copper in an amount of up to about 0.35% by weight, aluminum in an amount ranging from about 0.02% to about 0.45% by weight, vanadium in an amount ranging up to about 0.01% by weight, and calcium in an amount ranging up to about 0.003% by weight.

10. The earth boring bit of claim 7, included with a drilling system and disposed on a lower end of a drill string, where the drill string is driven by a top drive.

* * * * *

UNITED STATES PATENT AND TRADEMARK OFFICE

CERTIFICATE OF CORRECTION

PATENT NO. : 7,905,301 B2
APPLICATION NO. : 12/166954
DATED : March 15, 2011
INVENTOR(S) : Carmel Z. El Hakam et al.

It is certified that error appears in the above-identified patent and that said Letters Patent is hereby corrected as shown below:

Page 1, under (57) ABSTRACT:

line 6, delete “alloy further comprises”

IN THE CLAIMS:

Column 6, line 3, before “the earth” insert --wherein--
Column 6, line 3, after “bit” delete “comprising” and insert --comprises--

Signed and Sealed this
Twenty-first Day of June, 2011

David J. Kappos

David J. Kappos
*Director of the United States Patent and Trademark Office*